United States Patent [19]

Akkerman et al.

[11] 4,202,368

[45] May 13, 1980

[54] SAFETY VALVE OR BLOWOUT PREVENTER FOR USE IN A FLUID TRANSMISSION CONDUIT

[75] Inventors: Neil H. Akkerman; Kip B. Goans, both of New Orleans, La.

[73] Assignee: Baker CAC, Inc., Belle Chasse, La.

[21] Appl. No.: 886,204

[22] Filed: Mar. 13, 1978

[51] Int. Cl.[2] ..... F16K 17/20

[52] U.S. Cl. ..... 137/498

[58] Field of Search ..... 137/460, 498

[56] References Cited

U.S. PATENT DOCUMENTS

| | | | |
|---|---|---|---|
| 2,093,015 | 9/1937 | Madden | 137/498 X |
| 2,710,626 | 6/1955 | Burdick | 137/498 |

FOREIGN PATENT DOCUMENTS

| | | | |
|---|---|---|---|
| 1150253 | 6/1963 | Fed. Rep. of Germany | 137/640 |

*Primary Examiner*—Robert G. Nilson

*Attorney, Agent, or Firm*—William C. Norvell, Jr.

[57] ABSTRACT

Apparatus is provided for connection along a conduit for free flowing transmission of fluids in a first direction and for selective control of fluid flow in a second direction. The apparatus provides means whereby fluid flow in the second direction in excess of a predeterminable rate of the fluid flow permits a fixed volume displacement of fluid within the conduit without limitation upon the predeterminable rate of fluid flow. The apparatus also defines second means whereby fluid flow in the second direction and within the predeterminable rate of fluid flow permits an unrestricted volume displacement of the fluid through the conduit.

6 Claims, 4 Drawing Figures

SAFETY VALVE OR BLOWOUT PREVENTER FOR USE IN A FLUID TRANSMISSION CONDUIT

BACKGROUND OF THE INVENTION

1. Field of the Invention

The invention relates to a blowout preventer which may be utilized within the hydraulic circuitry extending from a control panel to a safety valve within a subterranean well.

2. Description of the Prior Art

In order to isolate a subterranean oil or gas well during a blowout, fire or other catastrophe, safety valves which may be manipulated between open and closed position by variance of hydraulic pressure contained within a line extending from the safety valve to a control panel at the surface of the well are utilized. Typically, such control systems have utilized an hydraulic-pneumatic interface valve which is sensitive to variance within a pneumatic signal source which detects abnormal well conditions such that the pneumatic signal will activate the interface valve to send hydraulic pressure to the downhole safety valve and maintain the safety valve in open position until an adverse well condition causes sufficient variation within the pneumatic signal source to, in turn, cause the interface valve to shift and vary the hydraulic pressure signal to the safety valve to manipulate it to closed position. As the hydraulic-pneumatic interface valve is activated, the interface assembly shifts to block hydraulic supply and concurrently bleeds pressure out of the control line extending to the downhole safety valve. However, such assemblies having an hydraulic-pneumatic valve within the console permit a continuous communication of fluid within the control line to the reservoir after the shut-in signal has been activated, because the dump port within the hydraulic-pneumatic interface valve is opened and remains opened even though the downhole safety valve has been manipulated to closed position. In the event of a packing, i.e., chevron seal, failure immediate the safety valve assembly, or in the event of a rupture within the control line extending to the well, the open port within the hydraulic-pneumatic interface valve assembly will permit well and control fluids to flow up through the control line and into the reservoir within the control unit. After a period of time the reservoir will overfill, and a resultant potential fire hazard or pollution environment may result. In geographically remote locations, this continuous abnormal control line bleeding might occur for considerable period of time before personnel could be sent to location to correct the deficiency, kill the well, or place the well back on production.

The present safety valve or blowout preventer is needed to remedy this particular problem without adversely affecting normal flow and operation during opening and closing manipulation of the safety valve. Additionally, the present blowout preventer is designed such that there is never adverse interference with control line flow during the opening mode for the downhole safety valve. More importantly, when the safety valve is desired to be closed during normal operations, the closing manipulation of the safety valve is not interfered with by utilization of the control line blowout preventer of the present invention when incorporated in the circuitry. The present blowout preventer is operable such that the safety valve may be repeatedly opened and reopened. Only when excessive flow returns are encountered within the blowout preventer during an abnormal closing of the safety valve, or during emergency shutdown of the well, is the blowout preventer feature of the present apparatus activated such that the control line from the blowout preventer to the safety valve is isolated from the hydraulic circuitry extending from the blowout preventer to the control panel. Additionally, the blowout preventer apparatus of the present invention permits automatic resetting such that the safety valve may be reopened even after excessive fluid volume returns are encountered through the apparatus as a result of returns of fluid in excess of the amount of fluid required to actually displace the safety valve to the closed position, as the result of utilization of a plurality of, for example, chevron seals to control pressure transmission immediate the safety valve.

Although the present invention preferably is utilized on control lines extending to subterranean safety valves or actuators therefor, it must be appreciated that the invention is readily adapted to any fluid transmission line, such as hydrocarbon pipe lines, and the like.

SUMMARY OF THE INVENTION

The present invention incorporates a safety valve or blowout preventer preferably comprising a housing and a piston means carried within the housing. First valve means carried in the housing have a bypass for metering flow of fluid in a first direction, the first valve means being shiftable to open position for passage of fluid therethrough in a second direction. Second valve means are provided and are maintained in opened position by the piston means when fluid flow in the first direction through the first valve means is within a predeterminable rate in the first direction, the second valve means being manipulatable to closed position by the piston means when an excess of predeterminable rate of fluid in the first direction is metered through the first valve means. Preferably, the blowout preventer is used in a control conduit for a safety valve which is manipulatable between open and closed positions upon one of increase and decrease of pressure within the control conduit. Additionally, the blowout preventer preferably provides the second valve means as manipulatable between open and closed positions by the piston means. Means for applying differential pressure across the piston means are provided within the apparatus to urge the piston means in a first direction and hold the piston means in a first position. The piston means is urged in a second direction when the rate of fluid flow through the first valve means exceeds the predeterminable rate, and subsequent to a predetermined volume displacement, the second valve means is manipulated to closed position to prohibit the flow of fluid in the first direction upstream and downstream of the blowout preventer. Incorporation of the blowout preventer in the fluid conduit will not adversely affect normal manipulation of the safety of other valve between open and closed position. The blowout preventer is repeatably manipulatable, is automatically resetting and does not require manual monitoring or manual resetting subsequent to manipulation of the second valve means to closed position.

DESCRIPTION OF THE PREFERRED EMBODIMENTS

Figure 1:
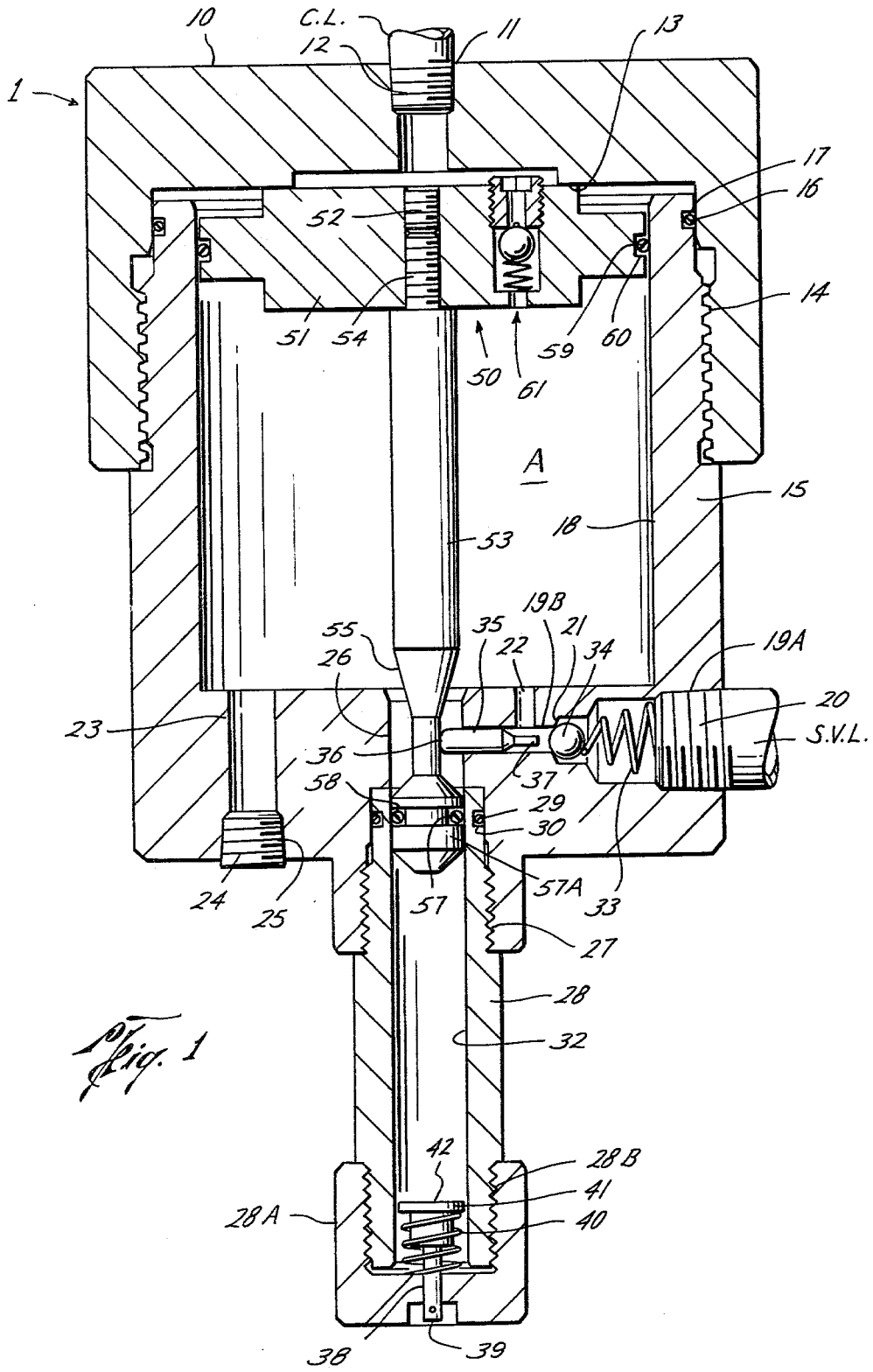
FIG. 1 is a longitudinal sectional view of the apparatus in position prior to initial pressure being applied through the control lines. Additionally, FIG. 1 also illustrates a position of the piston head and blowout valve subsequent to closure of the safety valve after abnormal well conditions have been encountered.

Referring now to FIG. 1, the blowout preventer 1 contains an upper cap 10 for receipt therethrough of a control line CL extending from the control panel (not shown) and secured by means of thread 12 within a bore 11. A shoulder 13 is defined interior on the cap 10 to stop the upper end of a sliding piston head 51. Threads 14 are provided for securing the cap 10 to an elongated cylindrical housing 15, a circumferentially extending elastomeric O-ring seal element 16 being housed within a bore 17 to prevent fluid communication between the housing 15 and the cap 10. The inner wall 18 of the cylindrical housing 15 provides a smooth surface for travel of the piston 51 as the safety valve is being manipulated between open and closed position.

A safety valve line SVL extending from the assembly 1 to the downhole safety valve (not shown) is sealingly engaged within the housing 15 through a bore **19*a* by means of threads 20. A small beveled seat 21 is provided within the housing 15 for selective companion sealing engagement of the exterior of a spherical ball element 34, the ball element 34 being normally urged toward the seat 21 by means of a compressed conical spring element 33 extending from the inner face of the safety valve line SVL. A bore 19*b* extends longitudinally within the housing 15 to provide fluid communication between the bore 19*a* and a piston chamber A within the housing 15 and below the piston head 51 by means of a port 22 defined within the housing 15**.

A longitudinally extending bore 23 is also provided within the housing 15 and communicates with the chamber A, the bore 23 being isolated from the exterior of the assembly 1 by means of a plug 24 secured sealingly within the bore 23 by means of threads 25. The bore 23 may be utilized by removing the plug 24 to manually dump fluid from the chamber A to the exterior of the apparatus 1. Alternatively, the plug 24 may be replaced by a eutectic apparatus which would permit dumping of fluid in the safety valve line SVL and the chamber A in the event of a fire immediate the apparatus 1. A stem bore 26 is centrally defined at the bottom of the housing 15 for receipt therethrough of the longitudinal stem 53.

The housing 15 is secured by means of threads 27 to a stem shaft 28 having a shaft wall 32 therein with an inner diameter equivalent to that of the stem bore 26, and for companion receipt of the stem 53. A static elastomeric O-ring element 29 is circumferentially extended within a bore 30 defined on the stem shaft 28 to prevent fluid communication between the shaft 28 and the housing 15. Again, the stem shaft 28 has a bore defined exterior of a wall 32 and having the same diameter as the stem bore 26. A smooth inner wall 32 is provided on the stem shaft 28 for travel of the stem 53 longitudinally within the shaft 28. The shaft 28 is terminated lowerly by means of a shaft cap **28*a* secured to the shaft 28 by means of thread 28*b***.

A bore 38 is longitudinally defined through the central lower end of the shaft 28 for receipt of a telltale shaft 39 therethrough. A compressible spring elemement 40 is extended around the exterior of that portion of the shaft 39 housed within the bore 31, the upper end of the spring 40 contacting the lower face of a disc element 41 secured to the upper end of the telltale shaft 39, the disc element 41 providing a seat 42 for the end of the longitudinally extending stem 53.

A control stem 35 is housed within the bore **19*b* between the ball 34 and the stem 53, the inner end 36 of the control stem 35 being urged toward and in contact with the exterior of the stem 53 by means of the compressive force defined through the spring 33 to the ball 34 and upon a tip 37 of the control stem 35**.

A piston assembly 50 is housed within the assembly 1 and with in the housing 15 and stem shaft 28. A piston head 51 of the assembly 50 is secured to a longitudinally extending stem 53 by means of threads 54, a set screw 52 being inserted through the upper end of the piston 51 to assure proper securement of the stem 53 to the piston head 51. The stem 53 is continued lowerly of the piston head 51 and extends through the stem bore 26. The stem 53 contains an inwardly beveled shoulder 55 which terminates in a longitudinally extending diametrically contracted stop elongate 56 for selective receipt of the inner end 36 of the control stem 35, as described below. The stem 53 continues lowerly of the stop 56 by means of a diametrically extended unit **57*a* housing an elastomeric O-seal 57 exterior of an engrooved bore 58 therein to prevent fluid communication between the unit 57*a* and the stem shaft 28**.

An elastomeric O-ring element 59 is carried exterior of the piston head 51 within an engrooved bore 60 therefor, the O-ring 59 contacting and sealingly engaging along the inner wall 18 of the housing 15 and preventing fluid communication between the head 51 and the housing 15.

A pressure chamber B is defined interior of the housing 15 between the upper face of the piston head 51 and the interior of the cap 10, while a similar chamber A is defined interior of the housing 15 and below the piston head 51.

Figure 4:
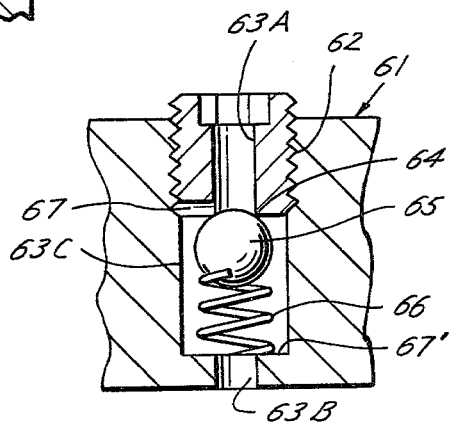
FIG. 4 is an enlarged cross-sectional view taken along the line 4—4 of FIG. 3.

The piston head 51 also carries a check valve assembly 61 on one side thereof and extending through the head 51. Referring to FIG. 4, the check valve assembly 61 is secured to the piston head 51 by means of threads 62. A bore **63*a* is communicable with a companion bore 63*b* by means of a small meter passage 67 contained within the assembly 61 within the bore 63*a* and a central flow passage 63*c*. A shoulder 67' is contained within the check valve assembly 61 for engagement of the lowermost end of a compressible spring element 66, the spring element 66 having its upper end resting around the exterior of a spherical element 65. An engrooved seat 64 is defined within the check valve assembly 61 for companion engagement of the exterior of the ball 65 when the spring 66** is permitted to expand.

OPERATION

Referring now to FIG. 1, the blowout preventer 1 is inserted along the hydraulic circuitry extending from the control panel (not shown) to the downhole safety valve (not shown), with the control line CL extending from the control panel being inserted within the bore 11 of the cap 10, and the line SVL extending from the safety valve being threadedly secured through the bore 19*a* of the housing 15.

When it is desired to manipulate the downhole safety valve to open position, fluid, preferably hydraulic, is transmitted within the circuitry from the panel and pressure is increased. The fluid passes within the control line CL, thence within chamber B above the piston head 51 and is permitted to pass through the bore 63*a* of the check valve assembly 61. As pressure is increased, the force defined through the spring 66 will be overcome and the ball 65 will be removed from the engagement on its seat 64 such that fluid will be permitted to pass not only through the meter passage 67 but freely around the ball 65 into the flow passage 63*c*, thence lowerly of the check valve assembly 61 and the piston head 51 through the bore 63*b*. The fluid is permitted to pass through the chamber A, thence within the housing 15 by means of the port 22. Thereafter, the fluid travels through the bores 19*a* and 19*b*, around the ball 34 and into the safety valve line SVL for subsequent transmission to the safety valve assembly in the well bore.

It should be noted that the effective piston area when pressure is applied within chamber A is defined by the dynamic seal 57 on the shaft 28 and O-ring 59 around the exterior of the piston head 51. Also, the effective piston area when pressure is applied within chamber B is defined by the ring 59 across the piston head 51. Accordingly, because the ring 57 is exposed to atmospheric pressure therebelow, as pressure is increased within the chambers A and B within the blowout preventer assembly 1 while the safety valve is being manipulated to open position, the piston head 51 and the stem 53 will be urged downwardly within the housing 15 because of the effective differential pressure areas between chambers A and B. It should be noted that the downward travel of the piston 51 and stem 53 is not substantially effected by the actual rate of flow of fluid from within Chamber B to within chamber A through the check valve assembly 61, the pressure within each of the chambers A and B being, at that time, substantially equal. Assuming that the subsurface safety valve fully opens before the piston 51 is displaced, fluid flow will terminate within the line SVL, and fluid from the lower chamber A will be displaced into chamber B through the metering passage 67 because the forces acting in chamber B exceed the forces acting in chamber A.

Figure 2:
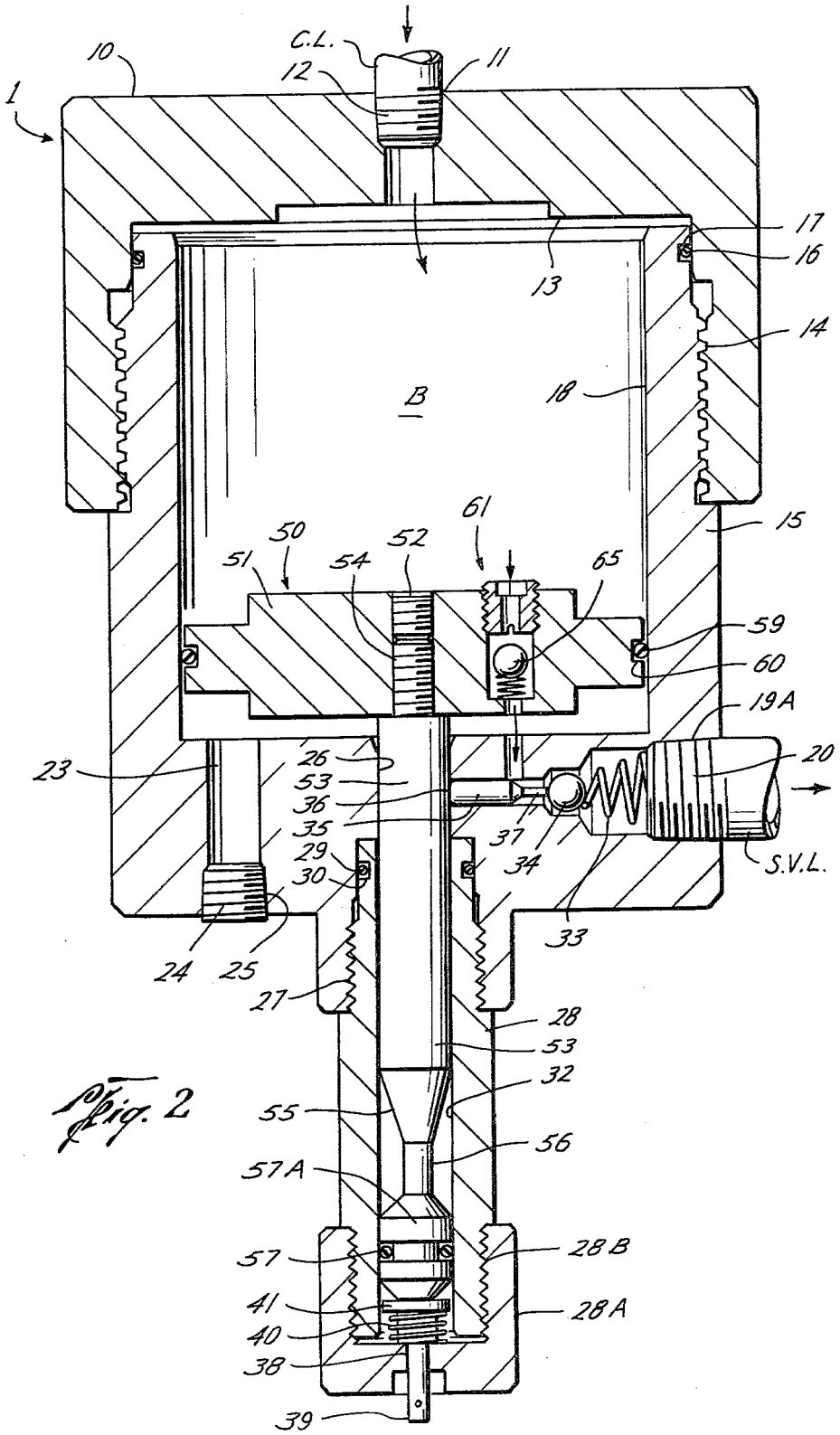
FIG. 2 is a view similar to that illustrated in FIG. 1, showing the apparatus in position while manipulating a safety valve to open position, the flow of hydraulic control fluid through the apparatus being illustrated by arrows.
Figure 3:
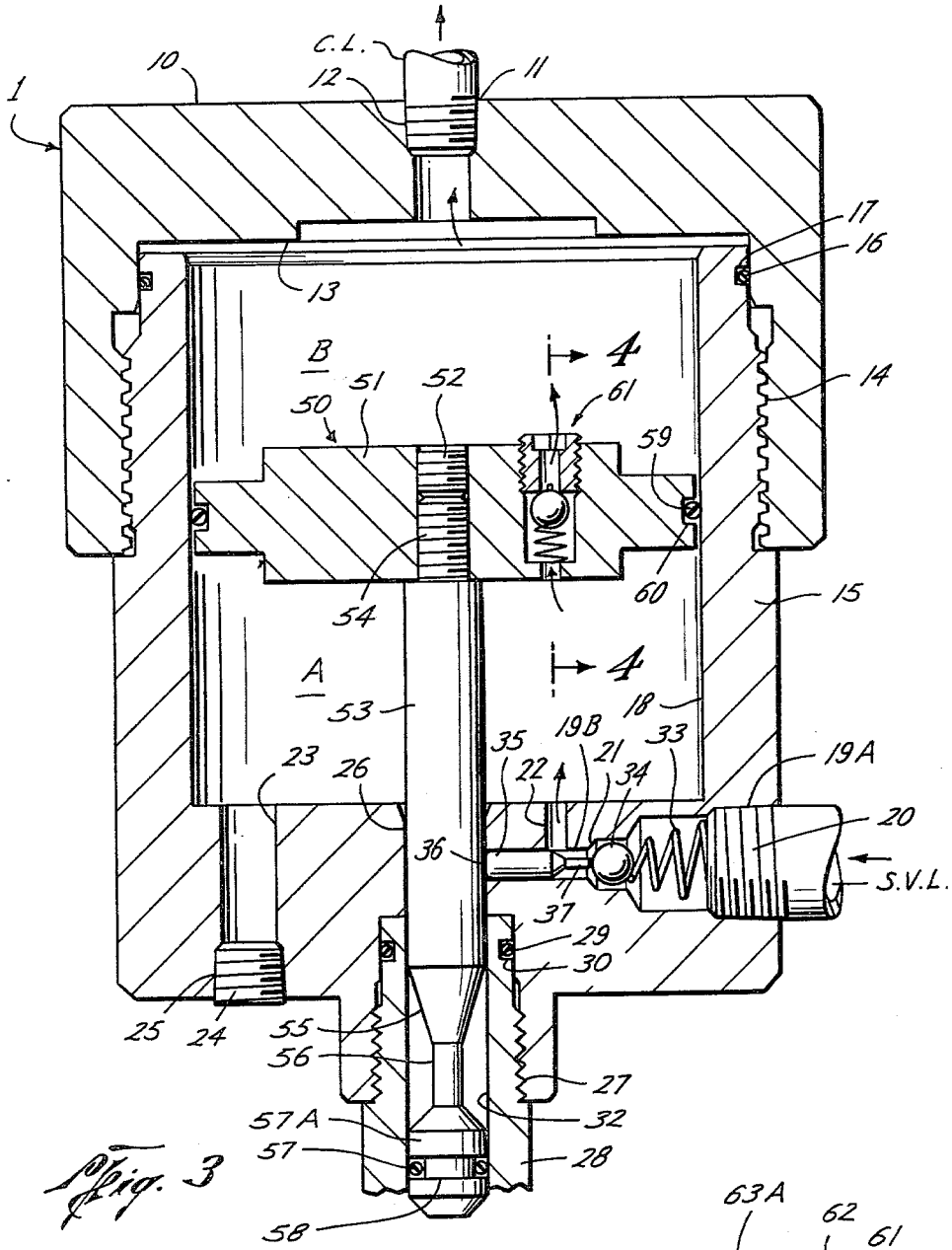
FIG. 3 is a longitudinal sectional view similar to those shown in FIGS. 1 and 2, and illustrating the positioning of the piston head during normal closure of the safety valve, the flow of hydraulic fluid from the safety valve thorugh the assembly thence through the control line to the control panel being illustrated by arrows.

As illustrated in FIG. 2, the piston head 51 and stem 53 will travel downwardly within the housing 15 such that the lower end 42 of the stem 53 will contact and engage the disc 41 to compress the spring 40 and permit the lower end of the telltale shaft 39 to extend exterior and through the bore 38 of the stem shaft 28, thus indicating that the piston head 51 and stem 53 have traveled downwardly within the housing 15, and the safety valve is in "open" position within the well bore and the apparatus 1 is completely reset.

When it is desired to reduce hydraulic pressure within the control conduit extending to the safety valve from the control panel to manipulate the safety valve to closed position for testing of the safety valve or during other normal operations, control fluid and pressure are bled from the control conduit CL to the control panel, such that fluid passes from the safety valve through the control line SVL, through the bore 19*a* around the ball 34, within the bore 19*b*, thence through the port 22 to the chamber A. Fluid then must be metered through the meter passage 67, and the spring 66 will hold the ball onto sealing engagement onto the seat 64. As fluid is metered through the passage 67, it is permitted to pass within the bore 63*a* to the chamber B, thence within the bore 11 of the cap 10 and through the control line CL to the control panel where it is bled off. It should be noted that as pressure is reduced within chambers A and B because of reduction of pressure in the fluid conduit extending to the control panel, there will be a differential pressure created between chamber A and B due to the metering of flow of fluid through the passage 67, the piston head 51 and the stem 53 will continue to be urged downwardly until flow through the metering passage 67 creates a differential pressure between chamber A and B. When sufficient differential pressure exists, the piston head 51 and stem 53 will rise. This metering rate is predeterminable, and is a function of the orifice size and the differential pressure areas across chambers A and B. When this flow rate is exceeded, the piston head 51 and stem 53 are permitted to "float" upwardly along the inner wall 18 of the housing 15 until such time as the downhole safety valve is manipulated to completely closed position. When the safety valve is in completely closed position, the pressure within the blowout preventer 1 will immediately drop to substantially zero and travel of the piston head 51 and stem 53 will be terminated. It should be noted that the length of free travel of the piston head 51 and stem 53 during normal metering of fluid through the passage 67 when the safety valve is manipulated to closed position is not sufficient to permit the control stem 35 to encounter the stop 56 on the stem 53, such that the ball 34 has remained, and continues to remain, sealingly disengaged from its seat 21 upon the housing 15.

It should be noted that while the stem 63 and the piston head 51 are floating upwardly, the differential pressure between chamber A and B is independent of flow rate in excess of the predeterminable rate of flow through the meter passage 67. Accordingly, flow in excess of the predeterminable rate permits fixed volume displacement without limiting flow rate.

When it is desired to reopen the downhole safety valve, the operational steps as described above are repeated. Thus, it can be seen that the assembly 1 does not interfere with the cyclical opening and reopening of the downhole safety valve and the rate of fluid flow is not adversely affected by the presence of the apparatus 1 within the control conduit.

In the event that an abnormal well condition is encountered such that control or well fluid continues to be transmitted through the safety valve line SVL extending from the downhole safety valve to the apparatus 1 after complete closure of the safety valve, it should be noted that the fluid will continue to be metered through the passage 67 and, because of continued flow of fluid through the line SVL, pressure will not be caused to be dropped substantially to zero within chambers A and B, and the piston head 51 and the stem 53 will continue upper longitudinal travel along the inner wall 18 of the housing 15. The ball 34 will remain off of its seat 21 by engagement of the control stem 35 until such time as the interface of the tip 36 of the control stem 35 with the exterior of the stem 53 is terminated by the beveled wall 55 of the stem 53 coming into longitudinal communication with the tip 36. As the tip 36 encounters the beveled wall 55, the bevel thereof and longitudinal travel of the stem 53 will slowly cause the control stem 35 to travel along the wall 55. Because the wall 55 is diametrically contracted from the upper exteriof of the stem 53, the control stem 35 will be urged to slide therealong, the force defined within the spring 33 shifting the control stem 35 latitudinally, along the ball 34. As the stem 53 moves upwardly longitudinally within the housing 15, the tip 36 of the control stem 35 will rest upon the stop 56 having an outer diameter substantially less than the outer diameter of the central portion of the stem 53 as well as the diameter of the beveled wall 55. The relationship of the length of the control stem 35 and the diameter of the stop 56 is such that as the stop 56 encounters the tip 36 of the control stem 35, the ball element 34 is urged to and is sealingly engaged upon its companion seat 21, the spring 33 holding the ball 34 onto the seat 21. When the ball 34 becomes sealingly engaged upon the seat 21, fluid flow from the line SVL through the bore **19*a* to the bore 19*b* is terminated and pressure within the chambers A and B of the apparatus 1 drops to substantially zero. The apparatus now is in the initial position as indicated in FIG. 1**.

Although the invention has been described in terms of specified embodiments which are set forth in detail, it should be understood that this is by way of illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and is desired to be secured by Letters Patent is:

1. A blowout preventer for use in a control conduit for a safety valve, said safety valve being manipulatable between opened and closed position upon variation of pressure within said control conduit, said blowout preventer comprising: a housing; piston means carried within said housing; first valve means for metering flow of fluid in first direction within said control conduit; and second valve means being maintained in opened position by said piston means when fluid flow through said first valve means is within a predeterminable rate in said first direction within said control conduit, said second valve means being manipulatable to closed position by said piston means when an excess of said predeterminable rate of fluid flow in said first direction within said control conduit is metered through said first valve means.

2. The blowout preventer of claim 1, said first valve means having a bypass for metering the flow of fluid in a first direction, said first valve means being shiftable to opened position for passage of fluid therethrough in a second direction.

3. The blowout preventer of claim 1 wherein said first valve means comprises: a spherical element; a compressible spring engaging said spherical element; and seat means for sealing engagement with said spherical element.

4. A blowout preventer for use in a control conduit for a safety valve, said safety valve being manipulatable between opened and closed position upon variation of pressure within said control conduit, said blowout preventer comprising: a housing; piston means carried within said housing; first valve means for metering flow of fluid in a first direction within said control conduit; and second valve means manipulatable between opened and closed position by said piston means, said second valve means being maintained in opened position by said piston means when fluid flow through said first valve means is within a predeterminable rate in said first direction within said control conduit, said second valve means being manipulatable to closed position by said piston means when an excess of said predeterminable rate of fluid flow in said first direction within said control conduit is metered through said first valve means.

5. The blowout preventer of claim 4, said first valve means having a bypass for metering flow of fluid in a first direction, said first valve means being shiftable to opened position for passage of fluid therethrough in a second direction.

6. The blowout preventer of claim 4, wherein said first valve means comprises: a spherical element; a compressible spring engaging said spherical element; and seat means for sealing engagement with said spherical element.

* * * * *